United States Patent [19]

Yanagishima et al.

[11] Patent Number: 4,550,428

[45] Date of Patent: Oct. 29, 1985

[54] DRIVER UNIT FOR AUTOMOTIVE AUDIO SPEAKER

[75] Inventors: Takayuki Yanagishima; Junichi Kasai, both of Yokosuka; Akio Ajimine, Tokyo; Tatsuya Watanabe, Tokyo; Akimitsu Shino, Tokyo; Yoshiaki Murakami, Tokyo, all of Japan

[73] Assignees: Nissan Motor Company, Limited; Clarion Co. Ltd., both of Japan

[21] Appl. No.: 500,573

[22] Filed: Jun. 2, 1983

[30] Foreign Application Priority Data

Jun. 8, 1982 [JP] Japan ..... 57-98055

[51] Int. Cl.[4] ..... H04R 9/00

[52] U.S. Cl. ..... 381/86; 179/181 W; 179/115.5 PC; 179/115.5 VC

[58] Field of Search ... 381/86; 179/181 W, 115.5 VC, 179/115.5 PC, 115.5 R, 115.5 ES, 119 R, 120, 181 R, 181 F

[56] References Cited

U.S. PATENT DOCUMENTS

| | | | |
|---|---|---|---|
| 2,761,913 | 9/1956 | Manley | 179/115.5 H |
| 3,268,672 | 8/1966 | Roesel, Jr. et al. | 179/115.5 R |
| 3,430,007 | 2/1969 | Thielen | 179/181 W |
| 3,449,531 | 6/1969 | Ashworth | 179/181 W |
| 3,567,870 | 3/1971 | Rivera | 179/181 W |
| 3,718,779 | 2/1973 | Schoengold | 179/115.5 |
| 3,861,495 | 1/1975 | Pearson | 181/163 |
| 3,983,337 | 9/1976 | Babb | 179/115.5 VC X |
| 3,993,345 | 11/1976 | Croup | 181/150 |
| 4,300,022 | 11/1981 | Hastings-Jones et al. | 179/115.5 DV |
| 4,354,067 | 10/1982 | Yamada et al. | 179/181 W X |
| 4,499,340 | 2/1985 | Kasai et al. | 179/115.5 DV |
| 4,514,599 | 4/1985 | Yanagishima et al. . | |

FOREIGN PATENT DOCUMENTS

| | | | |
|---|---|---|---|
| 56-13896 | 2/1981 | Japan | 179/181 W |
| 56-157199 | 12/1981 | Japan | 179/181 W |
| 2020509 | 11/1979 | United Kingdom . | |
| 2027316A | 2/1980 | United Kingdom . | |

OTHER PUBLICATIONS

Tremaine, Audio Cyclopedia, 1979, p. 1125.

*Primary Examiner*—James L. Dwyer
*Attorney, Agent, or Firm*—Lane and Aitken

[57] ABSTRACT

A driver unit for an audio speaker has a stationary component and a vibrating component associated with an automotive audio system and fixed to the vehicle panel. The stationary component is suspended from the vehicle body so that an electromagnetic section of the vibrating component is subject to a permanent magnetic field generated by the stationary component. A guide member is interposed between the stationary component and the vibrating component for guiding movement of the vibrating component in the axial direction. The guide member is adapted to restrict movement of the vibrating component in the direction perpendicular to the axial direction in order to prevent the vibrating component from being displaced laterally in relation to the permanent magnetic field.

9 Claims, 4 Drawing Figures

DRIVER UNIT FOR AUTOMOTIVE AUDIO SPEAKER

BACKGROUND OF THE INVENTION

The present invention relates generally to an automotive audio speaker which utilizes a vehicle panel as a sound-producing medium. More specifically, the invention relates to a driver unit for an automotive audio speaker, which prevents degradation of the audio sound output level caused by lateral displacement of a vibrating component with respect to a stationary component.

The automotive audio speaker utilizing at least a part of a vehicle panel, such as rear parcel shelf, door inner panel or the like, as a sound-producing medium has been recently developed. Such speakers have the benefit of producing better quality audio sound, especially in the relatively low frequency range.

Generally, such speakers include a driver unit for driving the vehicle panel at audio frequencies. The driver unit includes a stationary component establishing a permanent magnetic field and a vibrating component fixed to the vehicle panel and excited at the audio frequencies by an audio signal fed from an automotive audio system, such as a tape deck, radio receiver or the like. The vibrating component is subject to the magnetic field formed by the stationary component for driving the vehicle panel in response to the audio signal. The stationary component is suspended from the vehicle body by a resilient suspension member.

In such a structure, the vibrating component and the stationary component may tend to be displaced from their optimal spatial relationship with regard to the magnetic field due to movement of the vibrating component lateral to the axial driving direction during vibration.

The invention is to eliminate this drawback of automotive audio speaker driver units in speakers utilizing a vehicle panel as a sound-producing medium. In prinicple, this can be achieved by providing a guide member for allowing axial movement of the vibrating component and restricting lateral movement thereof.

SUMMARY OF THE INVENTION

Therefore, it is an object of the present invention to provide a driver unit for an automotive audio speaker including part of a vehicle panel as a sound-producing medium, which driver unit has a guide member for guiding movement of a vibrating component.

To achieve the above-mentioned and other objects, there is provided a driver unit for an audio speaker having a stationary component and a vibrating component associated with an automotive audio system and fixed to the vehicle panel. The stationary component is suspended from the vehicle body so that a permanent magnetic field generated by the stationary component envelopes an electromagnetic section of the vibrating component. A guide member is interposed between the stationary component and the vibrating component for guiding the vibrating component to move only in an axial direction. That is, the guide member is adapted to restrict vibrating component movement in a direction lateral to the desired excitation direction in order to prevent the vibrating componenet from being displaced in relation to the permanent magnetic field.

According to one embodiment of the present invention, a drive unit for an automotive audio system comprises a housing, a stationary component generating a permanent magnetic field and resiliently suspended within the housing, a vibrating component associated with a sound-producing medium for driving the latter at audio frequencies in response to an audio signal fed from an audio signal generator, the vibrating component being adapted to oscillate at audio frequencies along an axis of the stationary component, and means for guiding the axial movement of the vibrating component so as to prevent lateral displacement of the stationary and vibrating components.

According to another embodiment of the invention, there is provided an automotive audio speaker which comprises at least part of a vehicle panel constituting part of a vehicle body assembly and adapted to oscillate at an audio frequency, a driver unit including a housing secured to the vehicle panel, a stationary component generating a permanent magnetic field and resiliently suspended within the housing, a vibrating component associated with the vehicle panel for driving the latter at audio frequencies in response to an audio signal fed from an audio signal generator, the vibrating component being adapted to oscillate at audio frequencies along an axis of the stationary component, and means for guiding the axial movement of the vibrating component in order to prevent lateral displacement of the stationary and vibrating components.

BRIEF DESCRIPTION OF THE DRAWINGS

The present invention will be understood more fully from the detailed description given herebelow and from the accompanying drawings of the preferred embodiments of the invention, which, however, should not be taken as limitative to the invention but for elucidation and explanation only.

In the drawings.

DESCRIPTION OF THE PREFERRED EMBODIMENT

Figure 1:
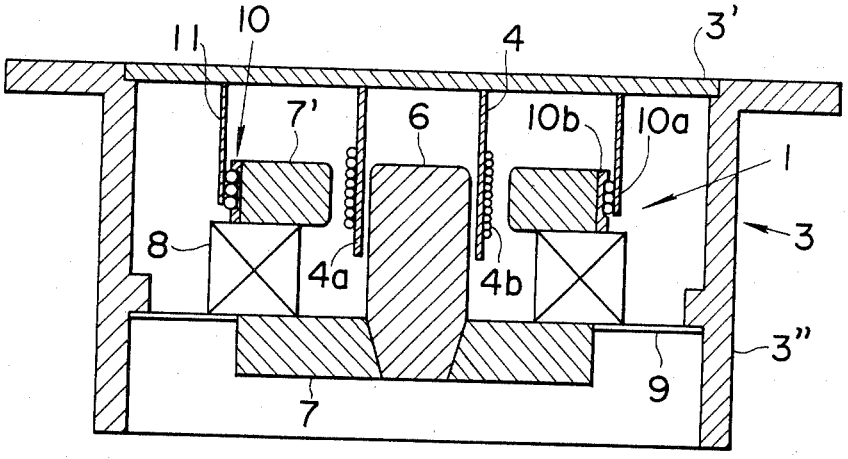
FIG. 1 is a cross-section of an automotive audio speaker with a vehicle panel serving as a sound producing medium, to which the first embodiment of a driver unit according to the present invention is applied.

Referring now to the drawings, particularly to FIG. 1, an automotive audio speaker generally comprises a vehicle panel 3' serving as a sound-producing medium, and a driver unit 3. The driver unit 3 has a housing 3'' defining a chamber for receiving a stationary component 1 and a vibrating component 4. The stationary component 1 comprises a flat yoke plate 7 with a central pole piece 6, an annular permanent magnet 8 and an annular yoke ring 7'. The yoke plate 7 and pole piece 6 form an assembly which is suspended from the housing 3'' by an annular leaf spring 9. The permanent magnet 8 and the yoke ring 7' are fixedly mounted on the yoke plate 7 and encircle the pole piece 6 with an annular space therebetween defining the contours of a permanent magnetic field.

A bobbin **4*a* is fixedly secured to the vehicle panel and is wound with a magnetic coil 4*b*. The magnetic coil 4*b* is connected to an automotive audio system, such as a tape deck, radio receiver or the like to receive an audio signal. The bobbin 4a and magnetic coil 4b as an assembly constitute the vibrating component 4 and are subject to the permanent magnetic field. The magnetic coil 4b** is adapted to be energized and deenergized by the audio signal at audio frequencies to drive the vehicle panel at audio frequencies for producing audio sound.

A bearing assembly 10 is attached to the outer periphery of the yoke ring 7'. The bearing assembly 10 comprises a base 10b fixed to the outer periphery of the yoke ring 7' and a plurality of bearing balls 10a received within the base. Opposing the bearing assembly 10, a cylindrical guide 11 is fixedly secured to the vehicle panel 3' with the inner periphery thereof in sliding contact with the bearing balls 10a.

As will be appreciated, the cylindrical guide 11 is so arranged as to have a common axis with the bobbin 4a and to guide axial movement of the bobbin-and-coil assembly 4, i.e. as the vibrating component. On the other hand, the cylindrical guide 11 in contact with the bearing balls 10a restricts the relative lateral displacement of the vibrating component 4 and the stationary component 1. As a result, the vibrating component 4 can be driven only in the axial direction to effectively drive the vehicle panel.

Figure 2:
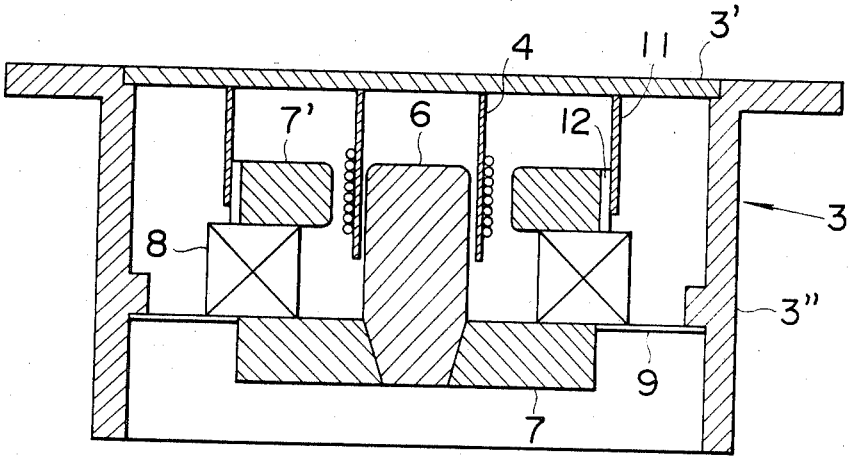
FIG. 2 is a cross-section of the speaker with a driver unit as a modification of the first embodiment.

FIG. 2 shows a modification of the foregoing first embodiment of the driver unit for the automotive audio speaker. In this modification, the bearing assembly 10 is replaced by a substantially smooth bearing surface 12 made of a smooth layer of a material with a low coefficient of friction, such as Teflon (tradename) available from DuPont. The cylindrical guide 11 is in sliding contact with the smooth bearing surface 12. When audio an signal is applied to the magnetic coil and thus the vehicle panel oscillates at audio frequencies, the cylindrical guide 11 guides the bobbin-and-coil assembly in the axial direction and restricts its lateral movement with respect to the stationary component 1.

Figure 3:
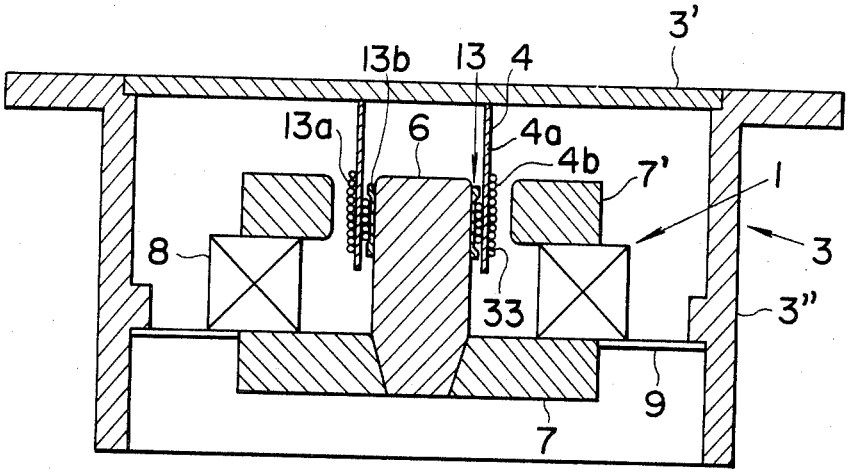
FIG. 3 is a cross-section of the speaker with the second embodiment of driver unit.

FIG. 3 shows the second embodiment of the driver unit for the automotive audio speaker according to the present invention. As in the foregoing first embodiment, the driver unit is housed in the housing 3'' which is secured to the vehicle panel 3' serving as the sound-producing medium. The driver unit generally comprises the stationary component 1 which includes the yoke plate 7 with pole piece 6, the permanent magnet 8 and the yoke ring 7', and the vibrating component 4 which includes the cylindrical bobbin 4a and the magnetic coil 4b wound around the bobbin. The stationary component 21 is suspended from the housing 3'' by the leaf spring 9.

According to the shown embodiment, a ball bearing assembly 13 is interposed between the outer periphery of the pole piece 6 and the inner periphery of the cylindrical bobbin 4a. The ball bearing assembly 13 comprises a bearing base 13b with a recess on its outer periphery and a plurality of bearing balls 33 received in the recess. The bearing base 13b is mounted near the free end of the pole piece 6 so that the bearing balls are in sliding contact with the inner periphery of the bobbin to allow sliding movement of the bobbin 4a only along the axis of the pole piece 6.

In this embodiment, the bearing ball should be made of a nonmagnetic material so that the bearing balls will not influence the permanent magnetic field and thus interfere with the movement of the bobbin-and-coil assembly.

According to this second embodiment, the inner periphery of the bobbin 4a in sliding contact with the bearing assembly 13 serves as the guide member guiding axial movement of the bobbin-and-coil assembly with respect to the stationary component 21.

Since the lateral movement of the bobbin 4a with respect to the axis of the pole piece 6 is restricted, lateral displacement between the stationary component and the vibrating component can never occur.

Figure 4:
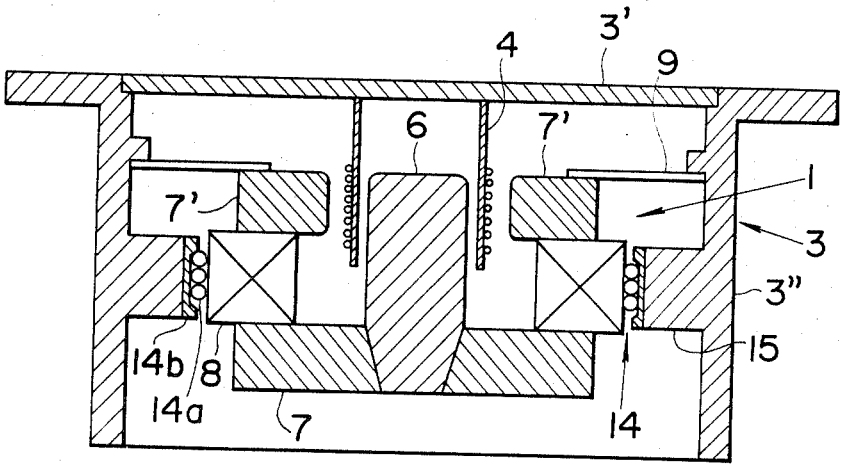
FIG. 4 is a cross-section of the third embodiment of driver unit according to the present invention.

FIG. 4 shows the third embodiment of the driver unit with the guide means, according to the invention. The driver unit is housed in the housing 3''. The housing is secured to the vehicle panel 3' which is adapted for oscillation at audio frequencies. The stationary component 1 of the driver unit is suspended within the housing 3'' by a leaf spring 9 which is secured to both the yoke ring 7' the housing. The vibrating component 4 has the bobbin 4a secured to the vehicle panel 3' and projecting into the space between the pole piece 6, and the yoke ring 7' and permanent magnet 8, and so is subject to the permanent magnetic field.

The housing 3'' is formed with an annular projection 15 projecting laterally inwards from the inner periphery of the housing. The annular projection 15 is ringed with a ball bearing assembly 14 which includes a bearing base 14b with a recess and a plurality of bearing balls 14a. As in the foregoing second embodiment, the bearing ball 14a should be made of a nonmagnetic material in order to prevent magnetic interference. The annular projection is designed to oppose the magnet 8 closely so that the bearing balls are always in contact with the outer periphery of the permanent magnet 8. Thus, the stationary component 41 is guided to oscillate axially when resonating in response to oscillation of the vibrating at audio frequencies. As a result, relative lateral displacement of the stationary component and the vibrating component is securely prevented.

As set forth, according to the present invention, relative lateral displacement of the stationary component and the vibrating component of the driver unit is satisfactorily prevented without complicated mechanisms and thus without significant increases in manufacturing costs.

While the specific embodiments have been disclosed hereabove in order to explain the present invention in detail, the driver unit having guide means for guiding relative movement of the stationary and vibrating component can be modified in various ways from the foregoing embodiments and can be embodied in other ways. Any possibly modifications and/or embodiments are to be understood as included in the present invention.

What is claimed is:

1. A speaker for an automotive audio system, comprising:

a housing;

a first component received within said housing and associated with a sound-producing medium for driving the latter, said first component responsive to an audio signal to be energized and deenergized at a frequency corresponding to the audio sound to be reproduced, and said first component being movable along an axis of the speaker depending upon energization and deenergization thereof;

a second component resiliently suspended within said housing and positioned in a given relationship to said first component, said second component producing a permanent magnetic field therearound through which said first component moves depending upon energization and deenergization thereof, said second component being movable relative to said first component while the latter moves with respect to said magnetic field; and means, associated with said second component, for guiding movement of said second component and restricting movement of said second component in a lateral direction relative to said axis, said guiding means comprising a guide member cooperative with said second component and coaxial with said first component, and a bearing associated with said guide member and said second component for allowing axial movement of said guide member while preventing movement thereof perpendicular to the axis thereof.

2. The driver unit as set forth in claim 1, wherein said sound-producing medium comprises a vehicle panel constituting part of a vehicle body assembly.

3. The driver unit as set forth in claim 2, wherein said guiding means comprises a guide member cooperative with said first component and coaxial with said second component and a bearing associated with said guiding member and said first component allowing relative axial movement thereof while preventing relative lateral movement thereof.

4. The driver unit as set forth in claim 1, wherein said guide member is of cylindrical shape and secured to the vehicle panel and adapted to establish sliding contact with said bearing along its inner periphery.

5. The driver unit as set forth in claim 2, wherein said second component comprises the assembly of a yoke plate, a pole piece, a yoke ring and an annular permanent magnet and said guiding means comprises a bearing coaxial with said first component and fixed to said housing so as to guide the movement of said magnet, and thus of said second component, to be solely along said axis.

6. An automotive audio speaker comprising:

a vehicle panel constituting a part of a vehicle body and at least having a part adapted to oscillate at audio frequencies;

a driver unit including:

a housing secured to said part of said vehicle panel;

a driver assembly generating a permanent magnetic field and resiliently suspended within said housing;

a voice coil assembly associated with said vehicle panel for driving the latter at audio frequencies in response to an audio signal;

said driver assembly and said voice coil assembly adapted to oscillate at audio frequencies along an axis of said voice coil assembly; and means, associated with said driver assembly for guiding movement of said driver assembly in order to prevent relative displacement of said driver assembly relative to said voice coil assembly in a direction perpendicular to said axis, said guiding means comprising a cylindrical guide member cooperative with said voice coil assembly and having a common axis to said driver assembly and a bearing contacting said guide member for allowing axial movement of said guide member.

7. An automotive audio speaker comprising:

a vehicle panel constituting a part of a vehicle body and at least having a part adapted to oscillate at audio frequencies:

a driver unit including:

a housing secured to said part of said vehicle panel;

a driver assembly generating a permanent magnetic field and resiliently suspended within said housing, a voice coil assembly associated with said vehicle panel for driving the latter at audio frequencies in response to an audio signal;

said driver assembly and said voice coil assembly adapted to oscillate at audio frequencies along an axis of said voice coil assembly; and means associated with said driver assembly for guiding movement of said driver assembly in order to prevent relative displacement of said driver assembly relative to said voice coil assembly in a direction perpendicular to said axis, wherein said guiding means comprises a guide member cooperative with said driver assembly and having the common axis with said voice coil assembly for movement therealong, and a bearing associated with said guiding member for axial movement thereof.

8. The speaker as set forth in claim 6, wherein said guide member is adapted to establish sliding contact with said bearing on the inner periphery of said guide member.

9. The speaker as set forth in claim 7, wherein said driving assembly comprises an assembly of yoke plates, a pole piece and a permanent magnet which is in contact with said bearing at the outer periphery of said permanent magnet for restricting relative deflection of the driver assembly.

* * * * *